US010920162B2

(12) United States Patent
Narita

(10) Patent No.: US 10,920,162 B2
(45) Date of Patent: Feb. 16, 2021

(54) LUBRICANT COMPOSITION, LUBRICATING METHOD AND TRANSMISSION

(71) Applicant: IDEMITSU KOSAN CO., LTD., Chiyoda-ku (JP)

(72) Inventor: Keiichi Narita, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/318,443

(22) PCT Filed: Oct. 19, 2017

(86) PCT No.: PCT/JP2017/037898
§ 371 (c)(1),
(2) Date: Jan. 17, 2019

(87) PCT Pub. No.: WO2018/074557
PCT Pub. Date: Apr. 26, 2018

(65) Prior Publication Data

US 2019/0264124 A1 Aug. 29, 2019

(30) Foreign Application Priority Data

Oct. 19, 2016 (JP) ..... 2016-205151

(51) Int. Cl.

| | |
|---|---|
| ***C10M 141/06*** | (2006.01) |
| ***C10M 133/08*** | (2006.01) |
| ***C10M 133/16*** | (2006.01) |
| ***C10M 133/44*** | (2006.01) |
| ***C10M 169/04*** | (2006.01) |
| ***C10M 133/56*** | (2006.01) |
| ***C10M 133/06*** | (2006.01) |
| *C10N 20/04* | (2006.01) |
| *C10N 30/02* | (2006.01) |
| *C10N 40/04* | (2006.01) |

(52) U.S. Cl.
CPC ..... *C10M 141/06* (2013.01); *C10M 133/06* (2013.01); *C10M 133/08* (2013.01); *C10M 133/16* (2013.01); *C10M 133/44* (2013.01); *C10M 133/56* (2013.01); *C10M 169/04* (2013.01); *C10M 2215/04* (2013.01); *C10M 2215/082* (2013.01); *C10M 2215/223* (2013.01); *C10N 2020/04* (2013.01); *C10N 2030/02* (2013.01); *C10N 2040/042* (2020.05)

(58) Field of Classification Search
CPC ..... C10M 2215/04; C10M 2215/082; C10M 2215/223; C10N 2230/02; C10N 2220/021; C10N 2240/042; C10N 2030/76; C10N 2040/04; C10N 2060/14; C10N 2060/09
See application file for complete search history.

(56) References Cited

U.S. PATENT DOCUMENTS

| | | | |
|---|---|---|---|
| 4,512,903 | A | 4/1985 | Schlicht et al. |
| 2006/0084583 | A1 | 4/2006 | Tipton et al. |
| 2010/0099593 | A1 | 4/2010 | Hurley et al. |
| 2010/0144565 | A1 | 6/2010 | Ikeda et al. |
| 2010/0216676 | A1 | 8/2010 | Ichihashi et al. |
| 2016/0075964 | A1 | 3/2016 | Komatsubara |

FOREIGN PATENT DOCUMENTS

| | | | |
|---|---|---|---|
| EP | 2 548 938 | A1 | 1/2013 |
| JP | 1-259096 | A | 10/1989 |
| JP | 2001-515099 | A | 9/2001 |
| JP | 2003-82375 | A | 3/2003 |
| JP | 2008-517107 | A | 5/2008 |
| JP | 2009-533536 | A | 9/2009 |
| JP | 2010-513695 | A | 4/2010 |
| JP | 2010-521556 | A | 6/2010 |
| WO | WO 2008/076825 | A1 | 6/2008 |
| WO | WO 2009/063752 | A1 | 5/2009 |
| WO | WO 2014/156307 | A1 | 10/2014 |

OTHER PUBLICATIONS

International Search Report dated Nov. 21, 2017 in PCT/JP2017/037898 filed on Oct. 19, 2017.
Extended European Search Report dated May 18, 2020 in Patent Application No. 17862685.9, 6 pages.
Japanese Office Action dated Jun. 23, 2020 in Japanese Patent Application No. 2016-205151 (with unedited computer generated English translation), 8 pages

*Primary Examiner* — Vishal V Vasisth
(74) *Attorney, Agent, or Firm* — Oblon, McClelland, Maier & Neustadt, L.L.P.

(57) ABSTRACT

Provided are a lubricating oil composition containing a component (A): a succinimide having an alkenyl group or an alkyl group, a component (B): a primary amine having a hydrocarbon group having 12 or more and 24 or less carbon atoms, a component (C): a fatty acid amide compound, and a component (D): an amide compound having a specific structure, and capable of satisfying both a high clutch capacity and a long anti-shudder lifetime; and a lubrication method and a transmission using the composition.

17 Claims, No Drawings

LUBRICANT COMPOSITION, LUBRICATING METHOD AND TRANSMISSION

TECHNICAL FIELD

The present invention relates to a lubricating oil composition, and to a lubrication method and a transmission using the lubricating oil composition.

BACKGROUND ART

As transmissions for use in automobiles, manual transmissions, automatic transmissions, continuously variable transmissions and the like are now placed on the market, and for the purpose of improving fuel efficiency, development of lock-up clutch-attached automatic transmissions is under way. For lock-up clutch control, direct fastening can be combined with slip control for power transmission with slipping, and in such a case where a lubricating oil is deteriorated, the μ-V characteristic between paper disc-metal plate worsens to often cause self-excited vibration called shudder. Accordingly, a lubricating oil is required to have a performance of securing a positive gradient μ-V characteristic and a more prolonged anti-shudder lifetime.

For the purpose of more prolonging an anti-shudder lifetime, in general, a positive gradient μ-V characteristic is maintained, and for reducing a frictional coefficient in a low-speed range, a friction modifier is blended. For example, a fluid composition for automatic transmissions prepared by adding a N-substituted dialkanolamine to a base oil whose viscosity has been controlled (see PTL 1), and a power transmission oil containing, as blended therein, a primary amine as an initial friction modifier and a dialkanolamine as a friction modifier that exhibits its effect after a lapse of time (see PTL 2) have been proposed.

Downsizing of automatic transmissions is required, and clutches such as lock-up clutches and transmission clutches are required to have a high clutch capacity. For realizing a high clutch capacity, usage of friction modifier will have to be reduced, but when the amount of a friction modifier to be used is reduced, there occurs a problem of shortening of an anti-shudder lifetime. Specifically, realization of a high clutch capacity and a long anti-shudder lifetime is said to be in a trade-off relationship.

The lubricating oil compositions described in the above-mentioned PTLs 1 and 2 could not satisfy both high clutch capacity and long anti-shudder lifetime. Given the situation, an automatic transmission oil composition that is tried to satisfy both high clutch capacity and long anti-shudder lifetime for a lock-up clutch by blending a predetermined carboxylic acid glyceride thereinto has been proposed (see PTL 3).

CITATION LIST

Patent Literature

PTL 1: JP H1-259096 A
PTL 2: JP 2001-515099 A
PTL 3: JP 2003-82375 A

SUMMARY OF INVENTION

Technical Problem

However, in recent situations where the demand for severer fuel saving and, with it, downsizing of automatic transmissions is increasing, even the automatic transmission oil composition described in PTL 3 could not be still said to sufficiently satisfy the two requirements of high clutch capacity and long anti-shudder lifetime. Accordingly, development of a lubricating oil composition capable of satisfying the severe requirements of both high clutch capacity and long anti-shudder lifetime is desired.

The present invention has been made in consideration of the above-mentioned situations, and objects thereof are to provide a lubricating oil composition capable of satisfying both high clutch capacity and long anti-shudder lifetime, and to provide a lubrication method and a transmission using the lubricating oil composition.

Solution to Problem

As a result of assiduous studies, the present inventors have found that the present invention mentioned below can solve the above-mentioned problems. Specifically, the present invention provides a lubricating oil composition having the constitution mentioned below, and a lubrication method and a transmission using the lubricating oil composition.

1. A lubricating oil composition containing a component (A): a succinimide having an alkenyl group or an alkyl group, a component (B): a primary amine having a hydrocarbon group having 12 or more and 24 or less carbon atoms, a component (C): a fatty acid amide compound, and a component (D): an amide compound represented by the following general formula (1):

(1)

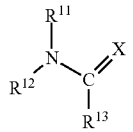

wherein $R^{11}$ and $R^{12}$ each independently represent a hydrocarbon group having 6 or more carbon atoms, $R^{13}$ represents a hydroxyalkyl group having 1 or more and 6 or less carbon atoms, or a group formed through condensation of the hydroxyalkyl group with an acylating agent via the hydroxy group, and X represents an oxygen atom or a sulfur atom.

2. A lubrication method, including using the lubricating oil composition of the above 1.
3. A transmission including the lubricating oil composition of the above 1.

Advantageous Effects of Invention

According to the present invention, there can be provided a lubricating oil composition capable of satisfying both high clutch capacity and long anti-shudder lifetime, and a lubrication method and a transmission using the lubricating oil composition.

DESCRIPTION OF EMBODIMENTS

Hereinunder, embodiments of the present invention (also referred to as the present embodiment) are described. In this description, the numerical values relating to "or more" and "or less" may be combined in any manner.

[Lubricating Oil Composition]

The lubricating oil composition for transmissions of the present embodiment contains a component (A): a succinimide having an alkenyl group or an alkyl group, a component (B): a primary amine having a hydrocarbon group having 12 or more and 24 or less carbon atoms, a component (C): a fatty acid amide compound, and a component (D): an amide compound represented by the above-mentioned general formula (1).

<Component (A): Succinimide Having Alkenyl Group or Alkyl Group>

The component (A), a succinimide having an alkenyl group or an alkyl group (hereinafter also referred to as "succinimide (A)") functions mainly as a dispersant, and combined with the other components, this can improve clutch capacity and anti-shudder lifetime to thereby more sufficiently satisfy both a high clutch capacity and a long anti-shudder lifetime.

The succinimide (A) may be any of a succinic monoimide or a succinic bisimide, but is, from the viewpoint of more sufficiently satisfying both a high clutch capacity and a long anti-shudder lifetime, preferably a succinic monoimide of an alkenyl succinimide or an alkyl succinimide represented by the following general formula (2).

(2)

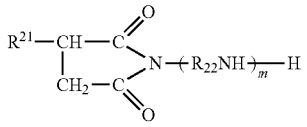

In the general formula (2), $R^{21}$ represents an alkenyl group or an alkyl group, $R^{22}$ represents an alkylene group, and m represents an integer of 1 or more and 20 or less. Plural $R^{22}$'s, if any, may be the same or different.

The mass average molecular weight of the alkenyl group or the alkyl group of $R^{21}$ is preferably 500 or more and 3,000 or less, more preferably 700 or more and 2,000 or less, and even more preferably 800 or more and 1,500 or less. When the mass average molecular weight is 500 or more, clutch capacity can be kept high and solubility in base oil improves. When the mass average molecular weight is 3,000 or less, anti-shudder lifetime is prolonged and dispersibility also improves. In this description, "mass average molecular weight" means a molecular weight as converted in terms of polystyrene, which is determined through gel permeation chromatography (GPC).

Specifically, examples of the alkenyl group include a polybutenyl group, a polyisobutenyl group, and an ethylene-propylene copolymer, and the alkyl group includes those derived from them through hydrogenation. Above all, the alkenyl group is preferably a polybutenyl group or a polyisobutenyl group. The polybutenyl group is preferably a mixture of 1-butene and isobutene, or one formed through polymerization of a high-purity isobutene. The alkyl group is preferably one derived from a polybutenyl group or a polyisobutenyl group through hydrogenation thereof.

The alkylene group of $R^{22}$ includes those having 2 or more and 5 or less carbon atoms, namely, various ethylene groups such as a 1,1-ethylene group and a 1,2-ethylene group, various propylene groups such as a 1,3-propylene group, a 1,2-propylene group, and a 2,2-propylene group (hereinunder the word "various" means to include linear and branched groups, and isomers thereof), various butylene groups, and various pentylene groups. The carbon number is more preferably 3 or 4.

m represents an integer of 1 or more and 20 or less, and is, from the viewpoint of dispersibility and solubility in base oil, preferably 1 or more and 10 or less, more preferably 2 or more and 5 or less, and even more preferably 3 or 4.

The succinimide (A) can be obtained, for example, by reacting an alkenylsuccinic anhydride to be obtained through reaction of a polyolefin and a maleic anhydride, or an alkylsuccinic anhydride to be obtained through hydrogenation of the alkenylsuccinic anhydride, with a polyamine.

Here, as the olefin monomer to form the polyolefin, one alone of an α-olefin having 2 or more and 8 or less carbon atoms, or a mixture of plural kinds thereof can be used, and use of a mixture of isobutene and 1-butene is preferred.

Preferred examples of the polyamine include simple diamines such as ethylenediamine, propylenediamine, butylenediamine, and pentylenediamine; polyalkylenepolyamines such as diethylenetriamine, triethylenetetramine, tetraethylenepentamine, pentaethylenehexamine, di(methylethylene)triamine, dibutylenetriamine, tributylenetetramine and pentapentylenehexamine; and piperazine derivatives such as aminoethylpiperazine.

In the present embodiment, one kind alone of the succinimide (A) may be used, or plural kinds thereof may be used in combination. In the present embodiment, preferably, plural kinds are used in combination, and use of two or more kinds of succinimides differing in the mass average molecular weight of the alkenyl group or the alkyl group therein is preferred. Using plural kinds of succinimides in combination makes it possible to more sufficiently satisfy both a high clutch capacity and a long anti-shudder lifetime.

In the present embodiment, preferably, the succinimide (A) contains a component (A1): a succinimide having an alkenyl group or an alkyl group having a mass average molecular weight of 1,200 or more and 1,500 or less (hereinafter this may be referred to as "succinimide (A1)"), and a component (A2): a succinimide having an alkenyl group or an alkyl group having a mass average molecular weight of 800 or more and less than 1,200 (hereinafter this may be referred to as "succinimide (A2)").

The mass average molecular weight of the alkenyl group or the alkyl group in the succinimide (A1) is preferably 1,250 or more and 1,450 or less, more preferably 1,300 or more and 1,400 or less. The mass average molecular weight of the alkenyl group or the alkyl group in the succinimide (A2) is preferably 850 or more and 1,150 or less, more preferably 900 or more and 1,100 or less. Combined use of the succinimide (A1) and the succinimide (A2) makes it possible to more sufficiently satisfy both a high clutch capacity and a long anti-shudder lifetime.

The content of the succinimide (A1) relative to the total amount of the succinimide (A1) and the succinimide (A2) is preferably 50% by mass or more and 80% by mass or less, more preferably 53% by mass or more and 75% by mass or less, even more preferably 55% by mass or more and 70% by mass or less. Use of the succinimide (A1) and the succinimide (A2) in such a ratio makes it possible to more sufficiently satisfy both a high clutch capacity and a long anti-shudder lifetime.

The content of the succinimide (A) is preferably 1% by mass or more and 10% by mass or less based on the total amount of the composition, more preferably 2% by mass or more and 9% by mass or less, even more preferably 3% by mass or more and 8% by mass or less. The content of the succinimide (A) to fall within the above-mentioned range makes it possible to more sufficiently satisfy both a high clutch capacity and a long anti-shudder lifetime.

<Component (B): Primary Amine Having Hydrocarbon Group Having 12 or More and 24 or Less Carbon Atoms>

The component (B), a primary amine having a hydrocarbon group having 12 or more and 24 or less carbon atoms (hereinafter this may be referred to as "primary amine (B)") functions mainly as a friction modifier and, combined with the other components, this can improve clutch capacity and anti-shudder lifetime to thereby more sufficiently satisfy both a high clutch capacity and a long anti-shudder lifetime.

The hydrocarbon group, which the primary amine (B) has, has 12 or more and 24 or less carbon atoms. When the carbon number is 12 or less, it is difficult to better the μ-V characteristic of lock-up clutches. On the other hand, when the carbon number is more than 24, clutch capacity could not be improved and it is difficult to better the μ-V characteristic of lock-up clutches. From the above, it is impossible to more sufficiently satisfy both a high clutch capacity and a long anti-shudder lifetime. From the same viewpoints, the carbon number of the hydrocarbon group is preferably 14 or more and 22 or less, more preferably 15 or more and 21 or less, even more preferably 16 or more and 20 or less.

Preferred examples of the hydrocarbon group include an alkyl group and an alkenyl group.

The alkyl group includes various dodecyl groups, various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl groups, various tricosyl groups and various tetracosyl groups.

The alkenyl group includes various dodecenyl groups, various tridecenyl groups, various tetradecenyl groups, various pentadecenyl groups, various hexadecenyl groups, various heptadecenyl groups, various octadecenyl groups, various nonadecenyl groups, various eicosenyl groups, various heneicosenyl groups, various docosenyl groups, various tricosenyl groups, and various tetracosenyl groups.

More specifically, the primary amine (B) is preferably an aliphatic primary amine such as n-dodecylamine, n-tridecylamine, n-tetradecylamine, 2-methyl-n-tridecylamine, n-pentadecylamine, n-hexadecylamine, n-heptadecylamine, n-octadecylamine, isooctadecylamine, n-nonadecylamine, n-eicosylamine, n-octadecenylamine, stearylamine and oleylamine. Above all, stearyl amine and oleylamine are more preferred, and oleylamine is especially preferred. In the present embodiment, one kind alone of the primary amine (B) may be used or plural kinds thereof may be used in combination.

The primary amine (B) may be contained in the form of an amine salt formed with an acid phosphate or an acid phosphite. Preferred examples of the acid phosphate include ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. Preferred examples of the acid phosphite include ethyl hydrogen phosphite, propyl hydrogen phosphite, butyl hydrogen phosphite, ethylhexyl hydrogen phosphite, diethylhexyl hydrogen phosphite, dilauroyl hydrogen phosphite, and dioleyl hydrogen phosphite.

The content of the primary amine (B) as converted in terms of nitrogen atom is preferably 10 ppm by mass or more and 200 ppm by mass or less based on the total amount of the composition, more preferably 20 ppm by mass or more and 150 ppm by mass or less, even more preferably 30 ppm by mass or more and 100 ppm by mass or less. The content of the primary amine (B) as converted in terms of nitrogen atom falling within the above-mentioned range makes it possible to more sufficiently satisfy both a high clutch capacity and a long anti-shudder lifetime.

Also from the same viewpoint, the content of the primary amine (B) is preferably 0.01% by mass or more and 1% by mass or less based on the total amount of the composition, more preferably 0.02% by mass or more and 0.8% by mass or less, even more preferably 0.05% by mass or more and 0.5% by mass or less.

<Component (C): Fatty Acid Amide Compound>

The component (C), a fatty acid amide compound (hereinafter this may be referred to as "fatty acid amide compound (C)") functions mainly as a friction modifier, and combined with the other components, this can improve clutch capacity and anti-shudder lifetime to thereby more sufficiently satisfy both a high clutch capacity and a long anti-shudder lifetime.

The fatty acid amide compound (C) is not specifically limited so far as it is a compound having an aliphatic group and an amide bond (—C(=O)—N—) in the molecule, but is preferably a fatty acid amide compound having an alkyl group or an alkenyl group as the aliphatic group therein.

The carbon number of the aliphatic group is preferably 12 or more and 24 or less, more preferably 14 or more and 22 or less, even more preferably 16 or more and 20 or less. Regarding the alkyl group and the alkenyl group having a carbon number falling within the range, reference may be made to the examples of the alkyl group and the alkenyl group mentioned hereinabove as the hydrocarbon group in the primary amine (B).

Preferred examples of the fatty acid amide compound (C) include stearic acid amide, isostearic acid amide, lauric acid amide, myristic acid amide, palmitic acid amide, and oleic acid amide. In the present embodiment, one kind alone of the fatty acid amide compound (C) may be used or plural kinds thereof may be used in combination.

The content of the fatty acid amide compound (C) as converted in terms of nitrogen atom is preferably 20 ppm by mass or more and 400 ppm by mass or less based on the total amount of the composition, more preferably 50 ppm by mass or more and 300 ppm by mass or less, even more preferably 100 ppm by mass or more and 250 ppm by mass or less. The content of the fatty acid amide compound (C) as converted in terms of nitrogen atom falling within the above-mentioned range makes it possible to more sufficiently satisfy both a high clutch capacity and a long anti-shudder lifetime.

Also from the same viewpoints, the content of the fatty acid amide compound (C) is preferably 0.01% by mass or more and 1% by mass or less based on the total amount of the composition, more preferably 0.03% by mass or more and 0.8% by mass or less, even more preferably 0.05% by mass or more and 0.5% by mass or less.

<Component (D): Amide Compound Represented by General Formula (1)>

The component (D), an amide compound (hereinafter this may be referred to as "amide compound (D)") can, as combined with the other components, improve clutch capacity and anti-shudder lifetime, and makes it possible to more sufficiently satisfy both a high clutch capacity and a long anti-shudder lifetime, and is represented by the following general formula (1).

(1)

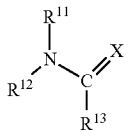

In the general formula (1), $R^{11}$ and $R^{12}$ each independently represent a hydrocarbon group having 6 or more carbon atoms. The hydrocarbon group includes an alkyl group, an alkenyl group, an alkadiene group, a cycloalkyl group, an aryl group and an arylalkyl group. Among these hydrocarbon groups, an alkyl group, an alkenyl group and an alkadiene group are preferred, and from the viewpoint of especially enhancing the stability of the amide compound to attain a more excellent effect, an alkyl group is more preferred. $R^{11}$ and $R^{12}$ may be the same or different, and the hydrocarbon group may be linear, branched or cyclic.

The carbon number needs to be 6 or more. When the carbon number is less than 6, a high clutch capacity and a long anti-shudder lifetime could not be obtained. From the viewpoint of more sufficiently satisfying both a high clutch capacity and a long anti-shudder lifetime, the carbon number is preferably 7 or more, more preferably 8 or more, even more preferably 10 or more. The upper limit is preferably 24 or less, more preferably 20 or less, even more preferably 18 or less.

The alkyl group includes, in addition to those having 12 or more and 24 or less carbon atoms as exemplified hereinabove for the alkyl group in the primary amine (B), various hexyl groups, various heptyl groups, various octyl groups, various nonyl groups, various decyl groups, and various undecyl groups.

The alkenyl group includes, in addition to those having 12 or more and 24 or less carbon atoms as exemplified hereinabove for the alkenyl group in the primary amine (B), various hexenyl groups, various heptenyl groups, various octenyl groups, various nonenyl groups, various decenyl groups, and various undecenyl groups.

Examples of the alkadiene group include various hexadiene groups, various heptadiene groups, various octadiene groups, various nonadiene groups, various decadiene groups, various undecadiene groups, various dodecadiene groups, various tridecadiene groups, various tetradecadiene groups, various pentadecadiene groups, various hexadecadiene groups, various heptadecadiene groups, various octadecadiene groups, various nonadecadiene groups, various eicosadiene groups, various heneicosadiene groups, various docosadiene groups, various tricosadiene groups, and various tetracosadiene groups.

Examples of the cycloalkyl group include a cyclohexyl group, various methylcyclohexyl groups, various ethylcyclohexyl groups, and various dimethylcyclohexyl groups; examples of the aryl group include a phenyl group, various methylphenyl groups, various ethylphenyl groups, various dimethylphenyl groups, various propylphenyl groups, various trimethylphenyl groups, various butylphenyl groups, and various naphthyl groups; examples of the arylalkyl group include a benzyl group, a phenethyl group, various phenylpropyl groups, various phenylbutyl groups, various methylbenzyl groups, various ethylbenzyl groups, various propylbenzyl groups, various butylbenzyl groups, and various hexylbenzyl groups.

The hydroxyalkyl group having 1 or more and 6 or less carbon atoms of $R^{13}$ includes a hydroxymethyl group, a hydroxyethyl group, various hydroxypropyl groups, various hydroxybutyl groups, various hydroxypentyl groups, and various hydroxyhexyl groups. The alkyl group contained in the hydroxyalkyl group may be linear, branched or cyclic. The carbon number of the hydroxyalkyl group of $R^{13}$ needs to be 1 or more and 6 or less. When the carbon number is more than 6, a high clutch capacity and a long anti-shudder lifetime could not be obtained. From the viewpoint of more sufficiently satisfying both a high clutch capacity and a long anti-shudder lifetime, the carbon number is preferably 5 or less, more preferably 4 or less, even more preferably 2 or less, and the lower limit may be 1 or more.

$R^{13}$ may also be a group to be formed through condensation of a hydroxyalkyl group with an acylating agent via the hydroxy group. The acylating agent includes carboxylic acid compounds such as carboxylic acids such as formic acid, acetic acid, succinic acid, and salicylic acid, halides thereof, and anhydrides thereof; and thiocarboxylic acid compounds such as thiocarboxylic acids such as thioacetic acid, thiopropionic acid and phenylthioacetic acid, and anhydrides thereof.

From the viewpoint of more sufficiently satisfying both a high clutch capacity and a long anti-shudder lifetime, $R^{13}$ is preferably a hydroxyalkyl group.

Regarding $R^{11}$ and $R^{12}$ in the general formula (1) that expresses the amide compound (D), the content of the hydrocarbon group having 12 carbon atoms among all $R^{11}$'s and $R^{12}$'s contained in the amide compound is preferably 30% by mass or more and 75% by mass or less, and the content of the hydrocarbon group having 14 carbon atoms is preferably 5% by mass or more and 40% by mass or less. Using the amide compound of the type makes it possible to more sufficiently satisfy both a high clutch capacity and a long anti-shudder lifetime. Here, "all $R^{11}$'s and $R^{12}$'s" means the entire amount (the total amount) of $R^{11}$'s and $R^{12}$'s in the amide compound represented by the general formula (1). Accordingly, the "content of the hydrocarbon group having 12 carbon atoms in all $R^{11}$'s and $R^{12}$'s" means the content of the hydrocarbon group having 12 carbon atoms contained as at least one of $R^{11}$ and $R^{12}$, based on the entire amount (total amount) of $R^{11}$'s and $R^{12}$'s, in the amide compound represented by the general formula (1). For example, in the case where plural kinds of amide compounds represented by the general formula (1) are used, the entire amount (the total amount) of $R^{11}$ and $R^{12}$ contained in all the amide compounds as combined is meant to indicate "all $R^{11}$'s and $R^{12}$'s", and the content of the hydrocarbon group having 12 carbon atoms contained as at least any one of $R^{11}$ and $R^{12}$ is meant to indicate the "content of the hydrocarbon atoms having 12 carbon atoms in all $R^{11}$'s and $R^{12}$'s".

From the viewpoint of more sufficiently satisfying both a high clutch capacity and a long anti-shudder lifetime, the content of the hydrocarbon group having 12 carbon atoms in all $R^{11}$'s and $R^{12}$'s is preferably 33% by mass or more, more preferably 35% by mass or more, even more preferably 40% by mass or more. The upper limit is preferably 70% by mass or less, more preferably 68% by mass or less, even more preferably 65% by mass or less. The content of the hydrocarbon group having 14 carbon atoms is preferably 7% by mass or more, more preferably 10% by mass or more, even more preferably 13% by mass or more. The upper limit is preferably 35% by mass or less, more preferably 30% by mass or less, even more preferably 25% by mass or less.

When the content of the hydrocarbon group having a carbon number of 12 and 14 in all $R^{11}$'s and $R^{12}$'s in the amide compound (D) falls within the above-mentioned range, these hydrocarbon groups may exist in any state in $R^{11}$ and $R^{12}$. For example, regarding the amide compound (D), $R^{11}$ and $R^{12}$ therein may have any carbon number of 12 and 14 like one having a hydrocarbon group having 12 carbon atoms as $R^{11}$ and having a hydrocarbon group having 14 carbon atoms as $R^{12}$, or one having a hydrocarbon group having 12 carbon atoms as $R^{11}$ and having a hydrocarbon group having 12 carbon atoms as $R^{12}$, or any one of $R^{11}$ and $R^{12}$ therein may be any of a hydrocarbon group having a carbon number of 12 and 14 like one having a hydrocarbon group having 16 carbon atoms as $R^{11}$ and having a hydrocarbon group having 14 carbon atoms as $R^{12}$. The amide compound (D) also includes an amide compound where $R^{11}$ and $R^{12}$ do not have a carbon number of 12 or 14.

As in the above, plural kinds of compounds represented by the general formula (1) may be combined for use for the amide compound (D), and for example, plural kinds of amide compounds of the general formula (1) where $R^{11}$ and $R^{12}$ are the same or different hydrocarbon groups may be combined for use herein.

From the viewpoint of more sufficiently satisfying both a high clutch capacity and a long anti-shudder lifetime, preferably, $R^{11}$ and $R^{12}$ in the amide compound (D) include an alkyl group having 12 carbon atoms (dodecyl group) and an alkyl group having 14 carbon atoms (tetradecyl group), and the content of the dodecyl group in all $R^{11}$'s and $R^{12}$'s is 30% by mass or more and 75% by mass or less, and the content of the tetradecyl group is 5% by mass or more and 40% by mass or less.

From the same viewpoint as above, preferably, the amide compound (D) contains, as the alkyl group therein, a dodecyl group and a tetradecyl group and at least one selected from an octyl group, a decyl group, a hexadecyl group, an octadecyl group and an octadecenyl group, and the content of the dodecyl group in all $R^{11}$'s and $R^{12}$'s is 30% by mass or more and 75% by mass or less, the content of the tetradecyl group is 5% by mass or more and 40% by mass or less, and the content of at least one selected from the octyl group, the decyl group, the hexadecyl group, the octadecyl group and the octadecenyl group is 1% by mass or more and 20% by mass or less.

X represents an oxygen atom or a sulfur atom, and is, from the viewpoint of attaining a high intermetallic friction coefficient and excellent anti-shudder performance, preferably an oxygen atom. The amide compound (D) includes both an amide compound where X is an oxygen atom and a thioamide compound where X is a sulfur atom, but an amide compound where X is an oxygen atom is preferred.

Examples of the amide compound represented by the general formula (1) include a reaction product using a secondary amine, more specifically a reaction product of a secondary amine and at least one selected from a hydroxycarboxylic acid and a hydroxythiocarboxylic acid.

The secondary amine may be a secondary amine having a hydrocarbon group exemplified hereinabove as $R^{11}$ and $R^{12}$. The hydroxycarboxylic acid and the hydroxythiocarboxylic acid include those having a hydroxyalkyl group exemplified hereinabove as $R^{13}$, and preferred examples thereof include hydroxycarboxylic acids such as hydroxyacetic acid (glycolic acid), various hydroxypropanoic acids, various hydroxybutanoic acids, various hydroxypentanoic acids, various hydroxyhexanoic acids, and various hydroxyheptanoic acids; and hydroxythiocarboxylic acids such as various hydroxypropanethioic acids, various hydroxybutanethioic acids, various hydroxypentanethioic acids, various hydroxyhexanethioic acids, and various hydroxyheptanethioic acids. Hydroxycarboxylic acids are more preferred.

Examples of the secondary amine usable herein include plant-derived secondary amines such as dicocoalkylamines obtainable from coconut, such as those containing at least a hydrocarbon group having 12 carbon atoms and a hydrocarbon group having 14 carbon atoms.

More specifically, the plant-derived secondary amine preferably includes a secondary amine containing a hydrocarbon group having 12 carbon atoms in an amount of 30% by mass or more and 75% by mass or less relative to all hydrocarbon groups, and containing a hydrocarbon group having 14 carbon atoms in an amount of 5% by mass or more and 40% by mass or less; more preferably a secondary amine where the hydrocarbon group having 12 carbon atoms is a dodecyl group and the hydrocarbon group having 14 carbon atoms is a tetradecyl group; even more preferably a secondary amine containing a dodecyl group and a tetradecyl group, and at least one selected from an octyl group, a decyl group, a hexadecyl group, an octadecyl group and an octadecenyl group; and especially preferably a secondary amine containing a dodecyl group and a tetradecyl group, and at least one selected from an octyl group, a decyl group, a hexadecyl group, an octadecyl group and an octadecenyl group, and containing the dodecyl group in an amount of 30% by mass or more and 75% by mass or less relative to all hydrocarbon groups, the tetradecyl group in an amount of 5% by mass or more and 40% by mass or less, and at least one selected from the octyl group, the decyl group, the hexadecyl group, the octadecyl group and the octadecenyl group in an amount of 1% by mass or more and 20% by mass or less.

As the secondary amine, a tallow-derived one is also usable herein, and examples thereof include those mainly having an ethylhexyl group having 8 carbon atoms and an octadecyl group having 18 carbon atoms. In these cases, the amide compounds to be obtained include plural kinds of the amide compounds represented by the general formula (1) where $R^{11}$ and $R^{12}$ are the same or different hydrocarbon groups. In the case where a plant-derived or tallow-derived one is used as the secondary amine, it may contain a primary amine and a tertiary amine as the case may be, and can contain them not detracting from the advantageous effects of the present invention.

The amide compound (D) is preferably an amide compound represented by the general formula (1) where $R^{11}$ and $R^{12}$ each are an alkyl group having 6 or more and 24 or less carbon atoms, and containing a dodecyl group and a tetradecyl group each in a predetermined amount, $R^{13}$ is a hydroxyalkyl group having 1 or more and 2 or less carbon atoms, and X is an oxygen atom.

Also preferably, the amide compound is an amide compound of a reaction product using a plant-derived secondary amine such as coconut, especially a reaction product using the secondary amine and a hydroxyacetic acid as a hydroxycarboxylic acid, specifically, an amide compound of the above-mentioned general formula (1) where $R^{11}$ and $R^{12}$ contain a dodecyl group and a tetradecyl group, and at least one selected from an octyl group, a decyl group, a hexadecyl group, an octadecyl group and an octadecenyl group each in a predetermined amount, $R^{13}$ is a hydroxymethyl group having 1 carbon atom, and X is an oxygen atom.

The content of the amide compound (D) as converted in terms of nitrogen atom, based on the total amount of the composition, is preferably 50 ppm by mass or more and 800 ppm by mass or less, more preferably 150 ppm by mass or more and 700 ppm by mass or less, even more preferably 250 ppm by mass or more and 550 ppm by mass or less. The content of the amide compound (D) falling within the above range makes it possible to more sufficiently satisfy both a high clutch capacity and a long anti-shudder lifetime.

For the same reason as above, the content of the amide compound (D), based on the total amount of the composition, is preferably 0.1% by mass or more and 3% by mass or less, more preferably 0.3% by mass or more and 2.5% by mass or less, and even more preferably 0.5% by mass or more and 2% by mass or less.

<Base Oil>

The lubricating oil composition of the present embodiment may further contain a base oil. The base oil is not specifically limited and may be a mineral oil or a synthetic oil.

The mineral oil includes atmospheric residues obtained through atmospheric distillation of crude oils such as paraffin-base mineral oils, naphthene-base mineral oils or intermediate-base mineral oils; distillates obtained through reduced-pressure distillation of such atmospheric residues; mineral oils obtained by purifying the distillates through one or more purification treatments of solvent deasphalting, solvent extraction, hydrocracking, solvent dewaxing, catalytic dewaxing or hydrorefining, for example, light neutral oils, medium neutral oils, heavy neutral oils, and bright stocks; and mineral oils obtained by isomerizing wax produced through Fischer-Tropsch synthesis (GTL wax).

As the mineral oil, those grouped in any of Groups 1, 2 and 3 in the base oil category by API (American Petroleum Institute) may be used, but those grouped in Groups 2 and 3 are preferred from the viewpoint of more effectively preventing sludge formation of attaining good viscosity characteristics and stability against oxidation degradation.

Examples of the synthetic oil include poly-α-olefins such as polybutene, ethylene-α-olefin copolymers, and α-olefin homopolymers or copolymers; various esters such as polyol esters, dibasic acid esters, and phosphates; various ethers such as polyphenyl ethers; polyglycols; alkylbenzenes; and alkylnaphthalenes.

As the base oil, one of the above-mentioned mineral oils may be used alone or plural kinds thereof may be used in combination, or one of the synthetic oils may be used alone or plural kinds thereof may be used in combination. One or more kinds of mineral oils and one or more kinds of synthetic oils may be combined to give a mixed oil for use herein.

The viscosity of the base oil is not specifically limited. Preferably, the kinematic viscosity thereof at 100° C. is preferably 1.5 $mm^2/s$ or more and 4.5 $mm^2/s$ or less, more preferably 2 $mm^2/s$ or more and 4 $mm^2/s$ or less, even more preferably 2.5 $mm^2/s$ or more and 3.5 $mm^2/s$ or less. The kinematic viscosity at 40° C. of the base oil is preferably 8 $mm^2/s$ or more and 40 $mm^2/s$ or less, more preferably 10 $mm^2/s$ or more and 35 $mm^2/s$ or less, even more preferably 11 $mm^2/s$ or more and 30 $mm^2/s$ or less. When the kinematic viscosity of the base oil falls within the above range, fuel saving performance may be bettered and a sufficient oil film may be formed on the slide surface of gear bearings or clutches of transmission to reduce wear of devices owing to oil film break.

Also from the same viewpoint as above, the viscosity index of the base oil is preferably 80 or more, more preferably 90 or more, even more preferably 100 or more. In this description, the kinematic viscosity and the viscosity index are values measured using a glass capillary viscometer according to JIS K 2283:2000.

The content of the base oil based on the total amount of the composition is generally 50% by mass or more, preferably 60% by mass or more and 97% by mass or less, even more preferably 70% by mass or more and 95% by mass or less, still more preferably 75% by mass or more and 93% by mass or less.

<Other Additives>

The lubricating oil composition of the present embodiment may contain, within a range not detracting from the object of the present invention, any other additives than the component (A), the component (B), the component (C), the component (D) and base oil, for example, any other additives such as a viscosity index improver, a flow point depressant, an antioxidant, an oily agent, an extreme pressure agent, a dispersant, a metal-based detergent, a rust inhibitor, a metal deactivator, and an anti-foaming agent may be suitably selected and blended in the composition. One alone of these additives may be used or plural kinds thereof may be used in combination.

The lubricating oil composition of the present embodiment may contain the the component (A), the component (B), the component (C), the component (D) and base oil alone, or may contain these components and any other additives.

The total content of the other additives is not specifically limited within a range not running contrary to the object of the present invention, but in consideration of the effects of the additives, the total content thereof is, based on the total amount of the composition, preferably 0.1% by mass or more and 20% by mass or less, more preferably 1% by mass or more and 19% by mass or less, even more preferably 5% by mass or more and 18% by mass or less.

(Viscosity Index Improver)

Examples of the viscosity index improver include polymers such as a non-dispersant-type polymethacrylate, a dispersant-type polymethacrylate, an olefin-based copolymer (for example, an ethylene-propylene copolymer), a dispersant-type olefin-based copolymer, and a styrene-based copolymer (for example, a styrene-diene copolymer, a styrene-isoprene copolymer).

(Pour Point Depressant)

Examples of the pour point depressant include ethylene-vinyl acetate copolymers, condensation products of chloroparaffin and naphthalene, condensation products of chloroparaffin and phenol, polyalkylstyrenes, and polymethacrylates having a mass average molecular weight of 10,000 or more and 150,000 or less.

(Antioxidant)

Examples of the antioxidant include amine-based antioxidants such as diphenylamine-based antioxidants, and naphthylamine-based antioxidants; phenol-based antioxidants such as monophenol-based antioxidants, diphenol-based antioxidants, and hindered phenol-based antioxidants; molybdenum-based antioxidants such as molybdenum amine complexes produced by reacting molybdenum trioxide and/or molybdic acid and an amine compound; sulfur-based antioxidants such as phenothiazine, dioctadecyl sulfide, dilauroyl-3,3'-thiodipropionate, and 2-mercaptobenzimidazole; and phosphorus-based antioxidants such as triphenyl phosphite, diisopropylmonophenyl phosphite, and monobutyldiphenyl phosphite.

(Oily Agent)

Examples of the oily agent include aliphatic monocarboxylic acids such as stearic acid and oleic acid; polymer fatty acids such as dimer acids and hydrogenated dimers; hydroxy-fatty acids such as ricinoleic acid and hydroxystearic acid; aliphatic monoalcohols such as lauryl alcohol and oleyl alcohol; and fatty acid amides such as lauric acid amide and oleic acid amide.

(Extreme Pressure Agent)

Examples of the extreme pressure agent include sulfur-based extreme pressure agents such as sulfides, sulfoxides, sulfones and thiophosphinates; phosphorus-based extreme pressure agents such as phosphates; sulfur and phosphorus containing extreme pressure agents such as zinc dialkylthiocarbamates (Zn-DTP), molybdenum dialkylthiocarbamates (Mo-DTC), zinc dialkyldithiophosphates (Zn-DTP) and molybdenum dialkyldithiophosphates (Mo-DTP); and halogen-based extreme pressure agents such as chlorohydrocarbons.

(Dispersant)

Examples of the dispersant include ash-free dispersants such as boron-free succinimides, boron-containing succinimides, benzylamines, boron-containing benzylamines, succinates, and mono or dicarboxylic acid amides of typically fatty acids or succinic acid.

(Metal-Based Detergent)

Examples of the metal-based detergent include neutral metal sulfonates, neutral metal phenates, neutral metal salicylates, neutral metal phosphonates, basic metal sulfonates, basic metal phenates, basic metal salicylates, basic phosphonates, overbased metal sulfonates, overbased metal phenates, overbased metal salicylates and overbased phosphonates of alkaline earth metals such as calcium.

(Rust Inhibitor)

Examples of the rust inhibitor include petroleum sulfonates, alkylbenzene sulfonates, dinonylnaphthalene sulfonates, alkenyl succinates, and polyalcohol esters.

(Metal Deactivator)

The metal deactivator includes benzotriazole compounds tolyltriazole compounds, thiadiazole compounds and imidazole compounds.

(Anti-Foaming Agent)

Examples of the anti-foaming agent include silicone oils, fluorosilicone oils, and fluoroalkyl ethers.

(Various Physical Properties of Lubricating Oil Composition)

The kinematic viscosity at 100° C. of the lubricating oil composition of the present embodiment is preferably 1 $mm^2/s$ or more and 10 $mm^2/s$ or less, more preferably 2 $mm^2/s$ or more and 8 $mm^2/s$ or less, even more preferably 3 $mm^2/s$ or more and 7 $mm^2/s$ or less. The kinematic viscosity at 40° C. of the lubricating oil composition of the present embodiment is preferably 7 $mm^2/s$ or more and 30 $mm^2/s$ or less, more preferably 10 $mm^2/s$ or more and 27 $mm^2/s$ or less, even more preferably 12 $mm^2/s$ or more and 25 $mm^2/s$ or less. When the kinematic viscosity of the lubricating oil composition falls within the above range, fuel saving performance may be bettered and a sufficient oil film may be formed on the slide surface of gear bearings or clutches of transmissions to reduce wear of devices owing to oil film break.

Also from the same viewpoint as above, the viscosity index of the lubricating oil composition of the present embodiment is preferably 110 or more, more preferably 120 or more, even more preferably 125 or more.

The total nitrogen content in the lubricating oil composition of the present embodiment is preferably 1,000 ppm by mass or more and 3,000 ppm by mass or less, more preferably 1,200 ppm by mass or more and 2,500 ppm by mass or less, even more preferably 1,400 ppm by mass or more and 2,000 ppm by mass or less. When the total nitrogen content falls within the above range, both a high clutch capacity and a long anti-shudder lifetime can be more sufficiently satisfied.

The lubricating oil composition of the present embodiment has a clutch capacity (μs (static friction coefficient) at 100° C.) of 0.105 or more, 0.11 or more, or 0.113 or more. The value of the clutch capacity is a value measured according to the method described in the section of Examples given hereinunder.

The lubricating oil composition of the present invention has an anti-shudder lifetime of 380 hours or more, 500 hours or more, 600 hours or more, or 700 hours or more. The value of the anti-shudder lifetime is a value measured according to the method described in the section of Examples given hereinunder.

As described above, the lubricating oil composition of the present embodiment satisfies both a high clutch capacity and a long anti-shudder lifetime.

Taking advantage of such characteristic properties thereof, the lubricating oil composition of the present embodiment can be favorably used as a lubricating oil composition for transmissions, for example, for manual transmissions, automatic transmissions or continuously variable transmissions to be mounted on gasoline vehicles, hybrid vehicles, electric vehicles and the like. In particular, it is favorable as a lubricating oil composition for automatic transmissions equipped with a lock-up clutch that may often shudder. In addition, the lubricating oil composition of the present embodiment may be favorably used for other uses, for example, for internal combustion engines, hydraulic machines, turbines, compressors, working machines, cutting machines, gears, and machines equipped with liquid bearings or ball bearings.

[Lubrication Method and Transmission]

The lubrication method of the present embodiment is a lubrication method using the lubricating oil composition of the present embodiment described above. The lubricating oil composition for use in the lubrication method of the present embodiment satisfies both a high clutch capacity and a long anti-shudder lifetime. Accordingly, the lubrication method of the present embodiment is favorably used for transmissions such as manual transmissions, automatic transmissions or continuously variable transmissions to be mounted, for example, on gasoline vehicles, hybrid vehicles and electric vehicles, and in particular, the lubrication method is favorably used for lubrication in automatic transmissions equipped with a lock-up clutch that may often shudder. In addition, the lubrication method is also favorably used for other uses, for example, for lubrication of internal combustion engines, hydraulic machines, turbines, compressors, working machines, cutting machines, gears, and machines equipped with liquid bearings or ball bearings.

The transmission of the present embodiment uses the lubricating oil composition of the present embodiment. The transmission of the present embodiment uses the lubricating oil composition satisfying both a high clutch capacity and a long anti-shudder lifetime, and is therefore widely favorably applied to manual transmissions, automatic transmissions or continuously variable transmissions in various vehicles such as gasoline vehicles, hybrid vehicles and electric vehicles. In particular, it is favorable as an automatic transmission equipped with a lock-up clutch that may often shudder.

EXAMPLES

Next, the present invention is described in more detail with reference to Examples, but the present invention is not limited at all by these Examples.

Examples 1 to 6, Comparative Examples 1 to 4

Lubricating oil compositions were prepared at the blending ratio (% by mass) shown in Table 1. The resultant lubricating oil compositions were tested variously according to the methods mentioned below to evaluate the properties thereof. The evaluation results are shown in Table 1.

The properties of the lubricating oil compositions were measured and evaluated according to the methods mentioned below.

(1) Kinematic Viscosity

Kinematic viscosity at 40° C. and 100° C. was measured according to JIS K 2283:2000.

(2) Viscosity Index (VI)

Measured according to JIS K 2283:2000.

(3) Content of Nitrogen Atom

Measured according to JIS K 2609:1998.

(4) Clutch Capacity

In a static friction test according to JASO M348-2002, μs (static friction coefficient) at 100° C. was measured to be a clutch capacity.

(5) Clutch Anti-Shudder Lifetime

Evaluated according to JASO M349-2012. Concrete test conditions are as follows.

Friction material: cellulosic disc/steel plate

Oil amount: 150 mL

Oil temperature: 120° C.

Slip rate: 0.9 m/s

Slip time: 30 minutes

Downtime: 1 minute

Performance measurement: At intervals of 24 hours after the start of the test, μ-V characteristics were measured, and the time taken until the value of dμ/dV reached less than 0 at 80° C. was counted to be the clutch anti-shudder lifetime of the tested sample.

(Preconditioning operation: oil temperature, 80° C.; surface pressure, 1 MPa; slip rate, 0.6 m/s; time, 30 minutes)

TABLE 1

| | | | Example | | | | |
|---|---|---|---|---|---|---|---|
| | | | 1 | 2 | 3 | 4 | 5 |
| Blending Formulation | Base Oil | — | balance | balance | balance | balance | balance |
| | Succinimide (A) | % by mass | 5.00 | 5.00 | 5.00 | 5.00 | 5.00 |
| | Succinimide (A1) | % by mass | — | — | — | — | — |
| | Succinimide (A2) | % by mass | — | — | — | — | — |
| | Primary Amine (B) | % by mass | 0.107 | 0.107 | 0.107 | 0.107 | 0.107 |
| | Aliphatic Amide Compound (C) | % by mass | 0.300 | 0.300 | 0.300 | 0.300 | 0.300 |
| | Amide Compound (D) | % by mass | 1.32 | 1.32 | 0.880 | 0.587 | 0.293 |
| | Other Additives | % by mass | 17.5 | 17.5 | 17.5 | 17.5 | 17.5 |
| | Total | % by mass | 100 | 100 | 100 | 100 | 100 |
| Properties | Total Nitrogen Content | ppm by mass | 1642 | 1642 | 1492 | 1392 | 1292 |
| | Primary Amine (B) | ppm by mass *1 | 56 | 56 | 56 | 56 | 56 |
| | Fatty Acid Amide Compound (C) | ppm by mass *1 | 186 | 186 | 186 | 186 | 186 |
| | Amide Compound (D) | ppm by mass *1 | 450 | 450 | 300 | 200 | 100 |
| | 100° C. Kinematic Viscosity | $mm^2/s$ | 5.5 | 3.4 | 5.5 | 5.5 | 5.5 |
| | 40° C. Kinematic Viscosity | $mm^2/s$ | 22 | 13.6 | 22 | 22 | 22 |
| | Viscosity Index | — | 205 | 127 | 205 | 205 | 205 |
| Evaluation Results | Clutch Capacity (μs at 100° C.) | — | 0.114 | 0.115 | 0.115 | 0.115 | 0.116 |
| | Anti-shudder Lifetime | hr | 800 | 760 | 744 | 672 | 624 |

| | | | Example | Comparative Example | | | |
|---|---|---|---|---|---|---|---|
| | | | 6 | 1 | 2 | 3 | 4 |
| Blending Formulation | Base Oil | — | balance | balance | balance | balance | balance |
| | Succinimide (A) | % by mass | — | 5.00 | 5.00 | 5.00 | — |
| | Succinimide (A1) | % by mass | 3.00 | — | — | — | — |
| | Succinimide (A2) | % by mass | 2.00 | — | — | — | — |
| | Primary Amine (B) | % by mass | 0.107 | 0.107 | — | 0.107 | 0.107 |
| | Aliphatic Amide Compound (C) | % by mass | 0.300 | 0.300 | 0.300 | — | 0.300 |
| | Amide Compound (D) | % by mass | 1.32 | — | 0.880 | 0.880 | 0.880 |
| | Other Additives | % by mass | 17.5 | 17.5 | 17.5 | 17.5 | 17.5 |
| | Total | % by mass | 100 | 100 | 100 | 100 | 100 |
| Properties | Total Nitrogen Content | ppm by mass | 1622 | 1192 | 1436 | 1306 | 542 |
| | Primary Amine (B) | ppm by mass *1 | 56 | 56 | — | 56 | 56 |
| | Fatty Acid Amide Compound (C) | ppm by mass *1 | 186 | 186 | 186 | — | 186 |
| | Amide Compound (D) | ppm by mass *1 | 450 | — | 300 | 300 | 300 |
| | 100° C. Kinematic Viscosity | $mm^2/s$ | 5.5 | 5.5 | 5.5 | 5.5 | 5.5 |
| | 40° C. Kinematic Viscosity | $mm^2/s$ | 22 | 22 | 22 | 22 | 22 |
| | Viscosity Index | — | 205 | 205 | 205 | 205 | 205 |

TABLE 1-continued

| | | | | | | | |
|---|---|---|---|---|---|---|---|
| Evaluation Results | Clutch Capacity (μs at 100° C.) | — | 0.114 | 0.116 | 0.116 | 0.12 | 0.104 |
| | Anti-shudder Lifetime | hr | 784 | 360 | 0 | 0 | 196 |

*1: Content as converted in terms of nitrogen atom

Details of the components shown in Table 1 used in these Examples are as follows.

Base oil: mixed base oil of 60 N base oil and 150 N base oil (100° C. kinematic viscosity: 3.0 $mm^2/s$, 40° C. kinematic viscosity: 11.8 $mm^2/s$, viscosity index: 109)

Succinimide (A): polyisobutenylsuccinic monoimide (mass average molecular weight of polyisobutenyl group: 1,100, nitrogen content: 1.9% by mass)

Succinimide (A1): polyisobutenylsuccinic monoimide (mass average molecular weight of polyisobutenyl group: 1,300, nitrogen content: 1.7% by mass)

Succinimide (A2): polyisobutenylsuccinic monoimide (mass average molecular weight of polyisobutenyl group: 950, nitrogen content: 2.1% by mass)

Primary amine (B): oleylamine (nitrogen content: 5.2% by mass)

Fatty acid amide compound (C): isostearic acid amide (nitrogen content: 6.2% by mass)

Amide compound (D): amide compound of the genera formula (1) wherein $R^{11}$ and $R^{12}$ have at least a dodecyl group, a tetradecyl group, a decyl group, a hexadecyl group, an octadecyl group and an octadecenyl group, the content of each group relative to $R^{11}$ and $R^{12}$ is 61% by mass, 19% by mass, 5.5% by mass, 7% by mass, 2% by mass and 3.5% by mass, respectively, $R^{13}$ is a hydroxymethyl group, and this is a reaction product of a coconut-derived secondary amine (dicocoalkylamine) having $R^{11}$ and $R^{12}$, and glycolic acid. The nitrogen content of the compound is 3.4% by mass.

Other additives: viscosity index improver (non-dispersant-type polymethacrylate, mass average molecular weight: 30,000), antioxidant (amine-based antioxidant, phenol-based antioxidant), extreme pressure agent (phosphorus containing extreme pressure agent), copper deactivator (sulfur-based copper deactivator), anti-foaming agent (silicone-based anti-foaming agent)

From the results in Table 1, it is confirmed that the lubricating oil compositions of Examples 1 to 6 satisfy both a high clutch capacity and a long anti-shudder lifetime.

On the other hand, the lubricating oil composition of Comparative Example 1 not containing the amide compound (D) has a short anti-shudder lifetime, and the anti-shudder lifetimes of the lubricating oil composition of Comparative Example 2 not containing the primary amine (B) and the lubricating oil composition of Comparative Example 3 not containing the fatty acid amide compound (C) are 0, and are extremely short. The lubricating oil composition of Comparative Example 4 not containing the succinimide (A) has a low clutch capacity and a short anti-shudder lifetime.

From the results of Examples and Comparative Examples as mentioned above, it is confirmed that the lubricating oil composition of the present embodiment has a structure consisting of a combination of specific compositions which are the succinimide (A), the primary amine (B), the fatty acid amide compound (C) and the amide compound (D), and therefore satisfies both a high clutch capacity and a long anti-shudder lifetime, and that, when any one of these is absent, the lubricating oil composition could not satisfy both the two.

INDUSTRIAL APPLICABILITY

The lubricating oil composition of the present embodiment has characteristics of satisfying both a high clutch capacity and a long anti-shudder lifetime, and is therefore favorably used as a lubricating oil compositions for transmissions such as manual transmissions, automatic transmissions or continuously variable transmissions of gasoline vehicles, hybrid vehicles, electric vehicles and the like. In particular, the lubricating oil composition is favorably used for automatic transmissions equipped with a lock-up clutch often to cause shudder generation.

The invention claimed is:

1. A lubricating oil composition, comprising:

(A): a succinimide having an alkenyl group or an alkyl group;

(B): a primary amine having a hydrocarbon group having 16 or more and 20 or less carbon atoms;

(C): a fatty acid amide compound having an aliphatic group having 16 or more and 20 or less carbon atoms; and (D): an amide compound represented by formula (1):

(1)

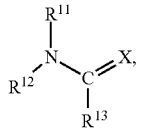

wherein:

$R^{11}$ and $R^{12}$ each independently represent a hydrocarbon group having 8 or more and 20 or less carbon atoms, $R^{13}$ represents a hydroxyalkyl group having 1 or more and 2 or less carbon atoms, and X represents an oxygen atom or a sulfur atom, wherein the content of the component (B) as converted in terms of nitrogen atom is, based on the total amount of the composition, 30 ppm by mass or more and 100 ppm by mass or less, the content of the component (C) as converted in terms of nitrogen atom is, based on the total amount of the composition, 100 ppm by mass or more and 250 ppm by mass or less, and the content of the component (D) as converted in terms of nitrogen atom is, based on the total amount of the composition, 50 ppm by mass or more and 550 ppm by mass or less.

2. The lubricating oil composition according to claim 1, wherein the succinimide (A) is a succinic monoimide.

3. The lubricating oil composition according to claim 1, wherein the succinimide (A) is two or more succinimides differing in mass average molecular weight of the alkenyl group or the alkyl group therein.

4. The lubricating oil composition according to claim 3, wherein the succinimide (A) comprises:

(A1): a succinimide having an alkenyl group or an alkyl group with a mass average molecular weight of 1,200 or more and 1,500 or less; and (A2): a succinimide having an alkenyl group or an alkyl group with a mass average molecular weight of 800 or more and less than 1,200.

5. The lubricating oil composition according to claim 4, wherein a content of the succinimide (A1) relative to a total amount of the succinimide (A1) and the succinimide (A2) is 50% by mass or more and 80% by mass or less.

6. The lubricating oil composition according to claim 1, wherein the primary amine (B) is at least one primary amine having an alkyl group or an alkenyl group with 16 or more and 20 or less carbon atoms.

7. The lubricating oil composition according to claim 1, wherein the fatty acid amide compound (C) is at least one fatty acid amide compound having an alkyl group or an alkenyl group with 16 or more and 20 or less carbon atoms.

8. The lubricating oil composition according to claim 1, wherein $R^{11}$ and $R^{12}$ each independently contain a hydrocarbon group having 12 carbon atoms and a hydrocarbon group having 14 carbon atoms, such that a content of the hydrocarbon group having 12 carbon atoms in all $R^{11}$'s and $R^{12}$'s is 30% by mass or more and 75% by mass or less, and a content of the hydrocarbon group having 14 carbon atoms is 5% by mass or more and 40% by mass or less.

9. The lubricating oil composition according to claim 8, wherein the hydrocarbon group having 12 carbon atoms is a dodecyl group and the hydrocarbon group having 14 carbon atoms is a tetradecyl group.

10. The lubricating oil composition according to claim 1, wherein $R^{11}$ and $R^{12}$ each independently contain a dodecyl group and a tetradecyl group, and at least one selected from the group consisting of an octyl group, a decyl group, a hexadecyl group, an octadecyl group and an octadecenyl group, such that a content of the dodecyl group in all $R^{11}$'s and $R^{12}$'s is 30% by mass or more and 75% by mass or less, a content of the tetradecyl group is 5% by mass or more and 40% by mass or less, and a content of at least one selected from an octyl group, a decyl group, a hexadecyl group, an octadecyl group and an octadecenyl group is 1% by mass or more and 20% by mass or less.

11. The lubricating oil composition according to claim 1 wherein:

$R^{13}$ is a hydroxyalkyl group having 1 or more and 2 or less carbon atoms; and X is an oxygen atom.

12. The lubricating oil composition according to claim 1, wherein the amide compound (D) is a reaction product formed from a plant-derived secondary amine containing a dodecyl group in an amount of 30% by mass or more and 75% by mass or less, a tetradecyl group in an amount of 5% by mass or more and 40% by mass or less, and at least one selected from the group consisting of an octyl group, a decyl group, a hexadecyl group, an octadecyl group and an octadecenyl group in an amount of 1% by mass or more and 20% by mass or less.

13. The lubricating oil composition according to claim 1, wherein a content of the succinimide (A) is, based on a total amount of the composition, 1% by mass or more and 10% by mass or less.

14. The lubricating oil composition according to claim 1, wherein a total nitrogen content is, based on a total amount of the composition, 1,000 ppm by mass or more and 3,000 ppm by mass or less.

15. The lubricating oil composition according to claim 1, which is adapted to function as a lubricating oil composition for a transmission.

16. A lubrication method, comprising lubricating an apparatus with the lubricating oil composition of claim 1.

17. A transmission, comprising the lubricating oil composition of claim 1.

* * * * *